US005261739A

United States Patent [19]

da Costa Goncalves et al.

[11] Patent Number: 5,261,739

[45] Date of Patent: Nov. 16, 1993

[54] MULTIFUNCTION CONSTRUCTION MACHINE

[76] Inventors: Antonio da Costa Goncalves, 46, rue des Fosses-Saint-Bernard, F-75005 Paris, France; Manuel J. da Costa Ferreira Dias, S. Sebastiao, Areias de Vilar, P-4750 Barcelos, Portugal

[21] Appl. No.: 930,508

[22] PCT Filed: Jan. 27, 1992

[86] PCT No.: PCT/FR92/00071

§ 371 Date: Nov. 13, 1992

§ 102(e) Date: Nov. 13, 1992

[87] PCT Pub. No.: WO92/13693

PCT Pub. Date: Aug. 20, 1992

[30] Foreign Application Priority Data

Jan. 31, 1991 [PT] Portugal ..... 96616

[51] Int. Cl.[5] ..... B28C 7/02

[52] U.S. Cl. ..... 366/30; 366/39; 366/61; 414/487; 414/501; 414/546; 414/551; 37/403; 37/304

[58] Field of Search ..... 366/26, 27, 30, 42, 366/64, 39, 45, 46, 47, 53, 60, 61; 37/4, 118 A, 117.5; 414/501, 551, 546, 487

[56] References Cited

U.S. PATENT DOCUMENTS

| | | | |
|---|---|---|---|
| 2,703,227 | 3/1955 | Hughes . | |
| 3,463,338 | 8/1969 | Schneider . | |
| 4,268,175 | 5/1981 | Norlie | 366/39 |
| 4,698,150 | 10/1987 | Wigoda | 37/4 |
| 4,825,567 | 5/1989 | Andiano | 37/117.5 |

FOREIGN PATENT DOCUMENTS

| | | | |
|---|---|---|---|
| 703402 | 2/1965 | Canada | 366/30 |
| 0268577 | 5/1988 | European Pat. Off. . | |
| 3617681 | 12/1987 | Fed. Rep. of Germany . | |
| 1216959 | 4/1960 | France . | |
| 2595107 | 9/1987 | France . | |
| 2117260 | 10/1983 | United Kingdom . | |

*Primary Examiner*—Robert W. Jenkins
*Attorney, Agent, or Firm*—Young & Thompson

[57] ABSTRACT

Multifunction building machine used in civil construction sites and public works. The machine combines on a self-propelled frame, a concrete-mixer (20) with a set of tools on one side, comprising a loading power shovel (60), a grader (70) and a digging shovel (80) and on the other side a dumper (50). The concrete mixer is of the fixed container type provided with a rotary mixer (33), a hinged cover (25) being adapted to form a spout for transfering the contents from the loading shovel to the dumper.

9 Claims, 2 Drawing Sheets

MULTIFUNCTION CONSTRUCTION MACHINE

The present invention concerns a multifunction machine used on civil construction and public works sites.

The various earthmoving, handling and concreting operations required on sites of this kind usually require the use of a plurality of machines respectively adapted to enable execution of these various types of works.

An object of the present invention is to offer, in particular for use on isolated sites, a multifunction machine combining in a self-contained unit a set of means able conveniently to meet practically all routine requirements in respect of earthmoving, handling and concreting.

To this end it proposes a machine as defined in claim 1 thereby offering in particular the possibility of using the same loading shovel either to handle various materials to be transferred by way of the dumper to a transport vehicle or for loading the concrete mixer to prepare a required quantity of concrete.

The loading shovel may advantageously be incorporated according to claim 2 into a judiciously selected set of moving tools such as a digging shovel and a grader.

According to an important feature of the invention the concrete mixer is of the fixed container type in accordance with claim 3 the advantages of which include a large increase in production capacity for the same overall size.

The features and advantages of the invention will emerge from the following description given by way of example with reference to the appended drawings, in which.

Figure 3:
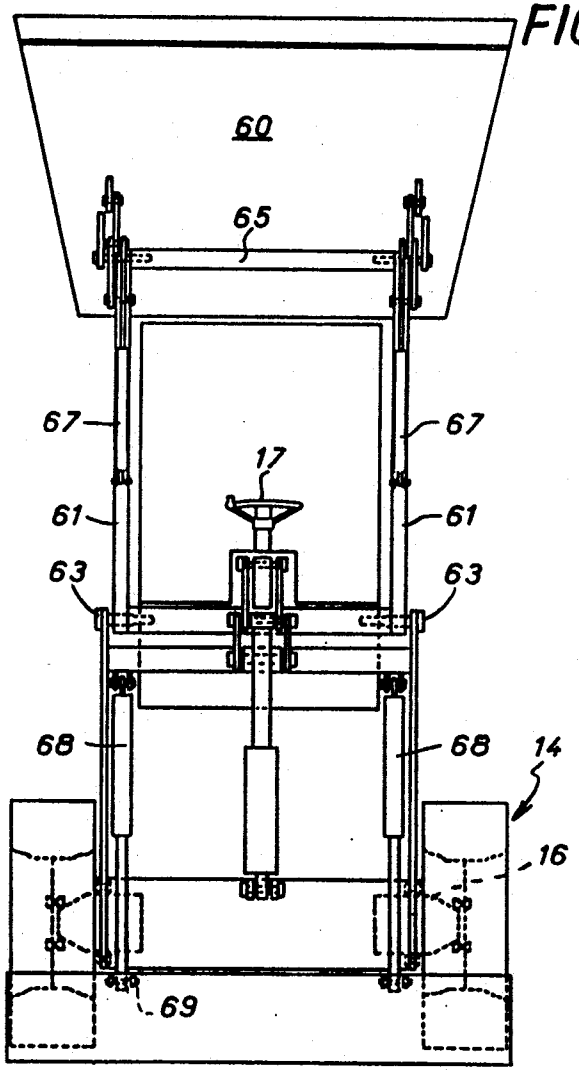
FIG. 3 is a front view in elevation in the direction of the arrows III—III in FIG. 1.

In the chosen embodiment shown the machine is constructed with a frame 10 having an anterior part 11 and a rear part 12 on respective sides of a central part 13. This frame is mounted on a pair of front wheels 14 and a pair of rear wheels 15, each of the four wheels being provided with a hydraulic motor, as indicated schematically at 16, for example, in FIG. 3. The rear wheels 15 can be steered by means of a steering mechanism (not shown) adapted to be controlled in the usual way by a steering wheel 17 installed for this purpose in a driver's cab schematically shown at 18 in FIG. 1.

In the central part of the machine is a concrete mixer 20 vertically above a water tank 21 with at its center a hydraulic fluid tank 22 immersed in the water in said tank 21.

By virtue of an arrangement that is not shown in the drawings because it is known in itself, the machine is provided with a hydraulic power plant driven by a single internal combustion engine and serving a set of control rams that will be referred to again later and the motors 16 etc coupled to the driving wheels, a motor associated with the concrete mixer and a water pump drive motor.

The concrete mixer 20 in the middle of the machine comprises a fixed tank with a semi-cylindrical lower part 23 above which is a prism-shape upper part 24 provided with a lid 25 in the shape of a chute with a bottom 26, two side walls 27, 28 and an inclined rear wall 29. This lid-chute is carried by two arms 30 articulated to a shaft 31 and adapted to be maneuvered by a pair of rams 32 between a concrete mixer closed position shown in full outline in FIG. 1 and a raised tipping position shown in chain-dotted outline at 25A in the same figure.

The fixed tank 20 of the concrete mixer is provided in its lower part with an internal stirrer 33 which comprises a shaft 34 adapted to be rotated by a hydraulic motor 35. Said shaft 34 carries through the intermediary of a series of tie-rods 37, 38, 39 two helical vanes 41, 42 each fitted with elastomer lips 43, 44 adapted to form scrapers in contact with the inside surface of the semi-cylindrical wall of the lower part 23 of the tank. The reversible motor 35 is adapted to urge the mass of concrete towards one or other of the two lateral walls 43 and 44, depending on the direction of rotation, the second wall 44 being provided with a hatch 45 which can be opened or closed by a pair of hydraulic rams 46.

Figure 1:
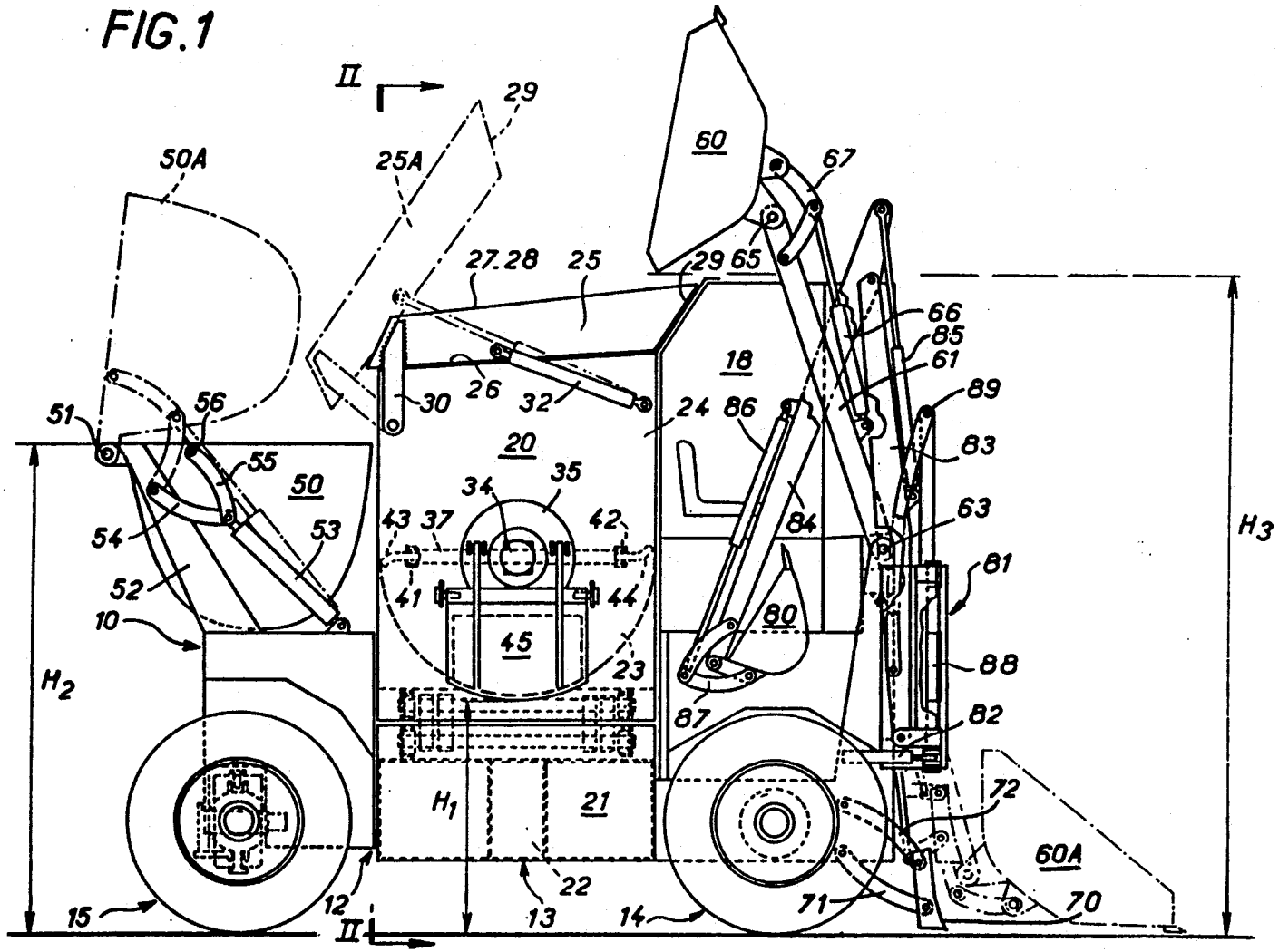
FIG. 1 is a view in side elevation of a machine in accordance with the invention.
Figure 2:
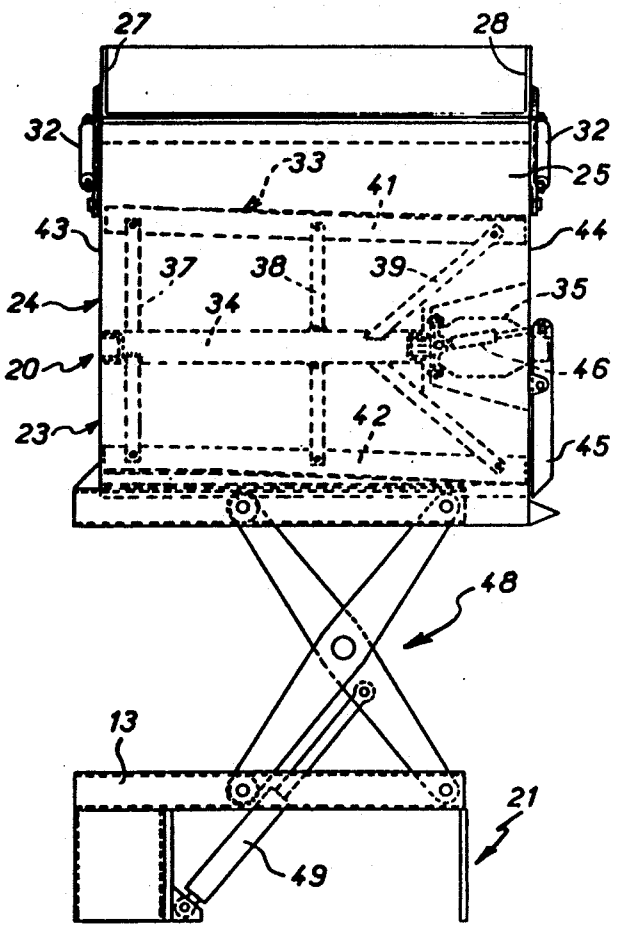
FIG. 2 is a diagrammatic view of the central part of the machine in the plane II—II in FIG. 1.

As can be seen from FIG. 2 the tank 20 of the concrete mixer is mounted on the central part 13 of the frame by means of a scissors-type lifting mechanism 48 operated by rams 49. The lower edge of the outlet orifice of the concrete mixer controlled by the hatch 45 is at a height $H_1$ of one meter when at rest, for example (FIG. 1), and the lifting mechanism 48 enables the concrete tipping height to be raised to a higher level $H_2$ of two meters, for example. A lifting mechanism of this kind (which is naturally optional) therefore makes it easier to pour the concrete.

It is virtually at this level $H_2$ that is located the edge of a dumper 50 pivoted about a shaft 51 carried by support arms 52 provided for this purpose on the rear part 12 of the frame. The dumper is adapted to be maneuvered between its rest position shown in full outline and the raised tipping position 58 shown in chain-dotted outline by means of a mechanism comprising on each side a ram 53 and a compass-like arrangement of two links 54, 55 respectively coupled to the support 52 and to a journal 56 of the dumper.

The front part 11 of the frame carries a set of earthmoving tools comprising in this instance a loading shovel 60, a grader 70 and a digging shovel 80.

The loading shovel 60 is shown in FIG. 1 in full outline in the raised offloading position and in chain-dotted outline in the lowered loading position (60A).

It is mounted at the end of maneuvering arms 61 articulated to the frame at 63 by a pivot shaft 65 with an operating mechanism on each side comprising a ram 66 and a compass-like pair of links 67. The maneuvering arms 61 are operated by rams 68 pivoted to a shaft 69 which is fixed relative to the frame.

In this embodiment the loading shovel 60 has a capacity of 0.5 $m^3$, the concrete tank 20 has a capacity of 2 $m^3$ and the dumper 50 has a capacity of 1 $m^3$. The water tank has a capacity of approximately 1 $m^3$, in other words 1000 liters, one fifth of which is occupied by the hydraulic liquid tank 22.

The loading shovel 60 is adapted to be filled in its lowered position 60A with any material available at this level: the height $H_3$ to which it can raise and from which it can offload this material is approximately 2.80 m in this example. Depending on the position selected for the lid-chute 25, this material can be offloaded either into the concrete mixer or into the dumper 50. It can be seen that in either case the material is transported over the top of the cab 18.

The lid-chute 25 advantageously has a volume substantially equal to that of the loading shovel, or 0.5 $m^3$ in this example: in the lid closed position the loading shovel can discharge into it without difficulty after which it can be raised to its tipping position 25A from which all of its content is dumped into the dumper 50 which can then be conveniently unloaded in its turn, into a truck for removal, for example.

The grader 70 is carried near ground level by pairs of arms 71, 72 articulated to either side of the anterior part 11 of the frame and maneuvered by two rams (not shown). The curved blade of the grader with its concave side facing forwards is 1.90 m wide and 0.35 m high in this example. In the rest position it is substantially aligned with the frame 11 and with its lower edge approximately 0.30 m above the ground. In the working position, on the other hand, its edge can be pressed at least 6 cm into the ground, for example to stabilize the machine during operation of the digging shovel 80 in particular, now to be described.

The digging shovel is carried by a vertical axis mount 81 which can be moved through an angle of at least 180° by a ram 82; it is fitted to this mount by a succession of two arms 83, 84 provided with rams 85, 86, the latter with a compass-like pair of links 67 operating the bucket forming the digging tool, which has a capacity of around 40 kg, for example. A ram 88 operates the first arm 83 through an articulated transmission enabling very great movement of the resulting digging shovel between a height in excess of four meters and a depth in excess of three meters, for example. During this movement the tool can remain close to vertical because of a double articulation in the transmission.

In this example the machine has an overall length of 4.70 m, a width of 1.90 m and a height of 2.8 m. It incorporates a 47.5 hp diesel engine to drive the hydraulic power plant serving all the rams, the motors 16 driving the driving wheels, the motor 35 of the mixer and a motor driving a water pump not mentioned hereinabove.

We claim:

1. Self-contained self-propelled earthmoving, handling and concreting machine characterized by the arrangement on a self-propelled frame (10) of a concrete mixer (20) between a dumper (50) on one side and a loading shovel (60) on the other, the concrete mixer having a top loading opening fitted with an articulated lid (25) adapted in the closed position to form a chute for transferring the contents of the shovel into the dumper.

2. Machine according to claim 1 characterized in that the loading shovel is part of a set of earthmoving tools installed at the front of the machine and including a digging shovel (80) and a grader (70).

3. Machine according to claim 1 characterized in that the concrete mixer comprises a fixed tank with a stirrer (33) rotating in a semi-cylindrical shape lower part (23) of said tank above which is a prism-shape upper part (24).

4. Machine according to claim 3 characterized in that the stirrer comprises two helical vanes (41, 42) on a shaft (34) coupled to a reversible motor (35) in order to urge the mass of concrete towards one or the other of two side walls, one fixed and the other equipped with an outlet hatch (45).

5. Machine according to claim 4 characterized in that said vanes are provided with elastomer lips (43, 44) forming scrapers.

6. Machine according to claim 3 characterized by the provision of a water tank (21) in the lower part under the concrete mixer with at its center a hydraulic fluid tank (22) immersed in the water.

7. Machine according to claim 6 characterized in that the concrete mixer is mounted on the water tank through the intermediary of a scissors-type lifting mechanism (48).

8. Machine according to claim 1 characterized in that it is equipped with a hydraulic power plant driven by a single internal combustion engine and serving all rams operating the various equipments and motors coupled to the driving wheels, to the stirrer and to the water pump.

9. Machine according to claim 1 characterized in that the capacity of the lid-chute (25) is substantially equal to the capacity of the loading shovel (60).

* * * * *